US005933180A

United States Patent [19]

Ruckl et al.

[11] Patent Number: 5,933,180

[45] Date of Patent: Aug. 3, 1999

[54] THERMAL PRINT MODULE AND METHOD OF USING SAME

[75] Inventors: Michael Ruckl, Unter Bruhl; Guenter Rudolf Weist, Birkenweg, both of Germany

[73] Assignee: BDT Products, Inc., Irvine, Calif.

[21] Appl. No.: 08/910,454

[22] Filed: Aug. 5, 1997

[51] Int. Cl.[6] ..... B41J 25/304

[52] U.S. Cl. ..... 347/197

[58] Field of Search ..... 347/197; 400/120.16

[56] References Cited

U.S. PATENT DOCUMENTS 5,255,989 10/1993 Berthold et al. ..... 400/605

*Primary Examiner*—Huan Tran

*Attorney, Agent, or Firm*—Higgs, Fletcher & Mack LLP; Bernard L. Kleinke, Esq.

[57] ABSTRACT

A thermal print module and method includes a two-part snap-together housing and encloses a heated print element. An insulated spring finger is integrally formed on one housing part to move the heated print element for receiving a thermal-sensitive ink carrier for loading it into its printing position within the unit, wherein the spring finger protects the user from inadvertently touching the heated element. A two-position lever is used alternatively to move the heated print element for carrier loading purposes. A sensor is activated by the lever to de-activate electrically the print module during carrier loading operations.

19 Claims, 3 Drawing Sheets

THERMAL PRINT MODULE AND METHOD OF USING SAME

CROSS-REFERENCE TO RELATED APPLICATIONS

1. Technical Field

The present invention relates in general to a new and improved thermal print module and method of using it for printing on thermal-sensitive ink carrier, such as thermal sensitive paper. The invention more particularly relates to such a new and improved module and method for printing documents such as receipts at a printing station, such as a point of sale terminal.

2. Background Art

Small thermal print devices have been employed for creating documents, such as receipts. For example, point of sale terminals frequently employ thermal print devices to create receipts on thermal paper. Such an arrangement provides a low cost printing operation, and it is small and compact in size, since it must fit within the terminal.

There is a variety of different kinds of thermal print devices. For example, reference may be made to U.S. Pat. No. 5,255,989, which discloses a thermal print device employing a thermal print head or module. While such a device may have been successful for many applications, the installation of new thermal paper into the device can be difficult. In this regard, the patented print head employ a heated print element to cause the selective printing onto the thermal paper. The hot printing element can cause serious burns to the fingers of the user attempting to thread the paper web into the printing device under some circumstances. Therefore, it would be highly desirable to have a new and improved technique for facilitating the loading of thermal sensitive ink carrier, such a thermal paper, into to the thermal print device in a safe and efficient manner, and at the same time in a manner which is convenient for the user.

Such a new and improved print module should also be relatively inexpensive to manufacture. In this regard, it would be highly desirable to have such a small, compact unit, which is conveniently manufacturable at a relative low cost.

DISCLOSURE OF INVENTION

Therefore, the principal object of the present invention is to provide a new and improved thermal print module and method of using it, wherein the module is more conveniently and efficiently used and which is relatively inexpensive to manufacture.

Briefly, the above and further objects of the present invention are realized by providing a new and improved thermal print module and method, wherein thermal sensitive ink carrier, such as thermal sensitive paper, can be loaded into the print module in a convenient and safe manner without undue risk to the user of sustaining burns from heated components of the module. Also, the inventive print module is relatively inexpensive to manufacture.

A thermal print module and method includes a two-part snap-together housing and encloses a heated print element. An insulated spring finger is integrally formed on one housing part to move the heated print element for receiving a thermal-sensitive ink carrier for loading it into its printing position within the unit, wherein the spring finger protects the user from inadvertently touching the heated element. A two-position lever is used alternatively to move the heated print element for carrier loading purposes. A sensor is activated by the lever to de-activate electrically the print module during carrier loading operations.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
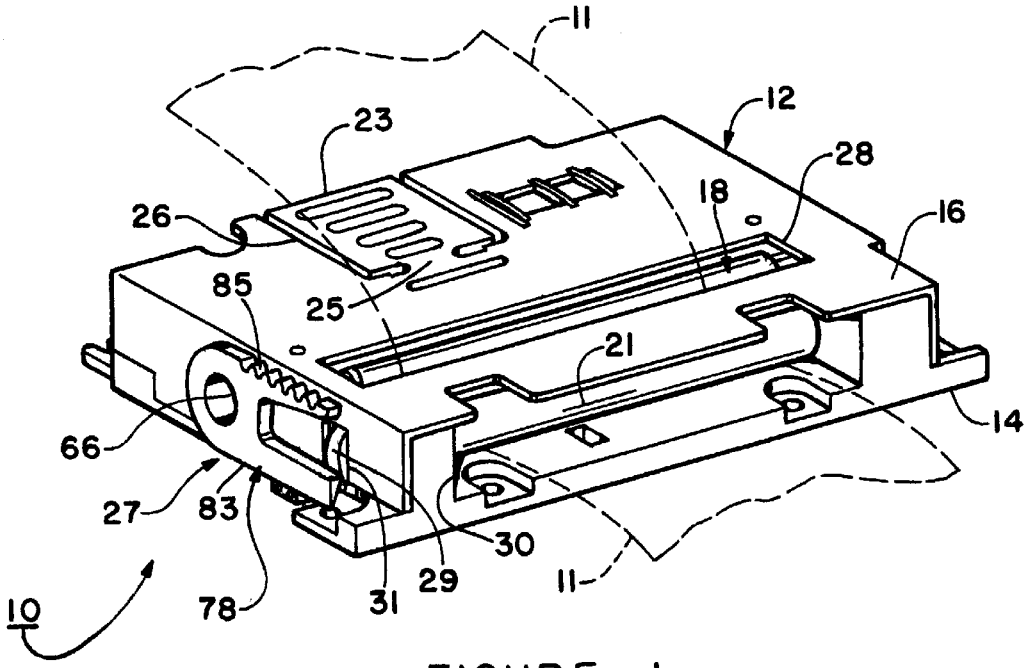
FIG. 1 is a pictorial view of a thermal print module, which is constructed in accordance with the present invention, and which illustrates the feeding of thermal-sensitive ink carrier therethrough for printing purposes.
Figure 2:
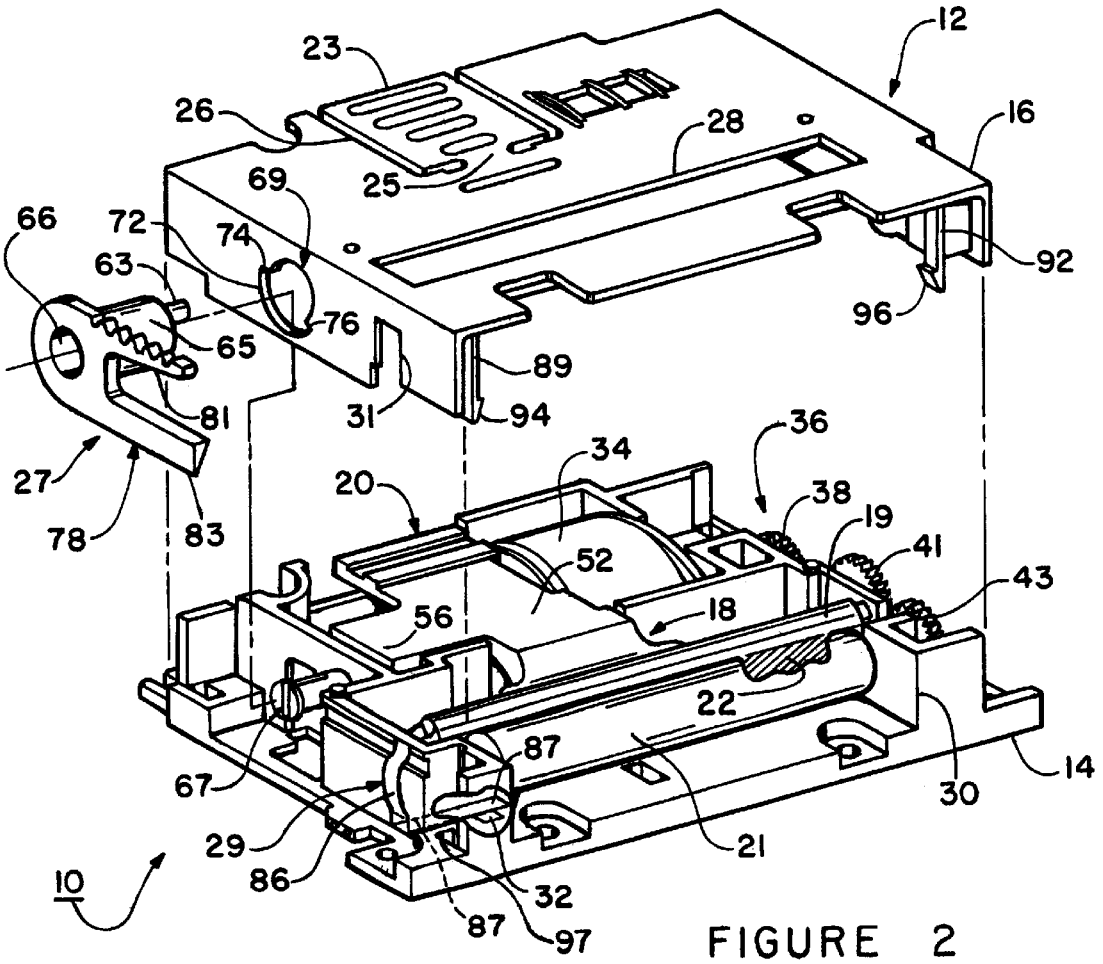
FIG. 2 is an exploded view of the module of FIG. 1.
Figure 3:
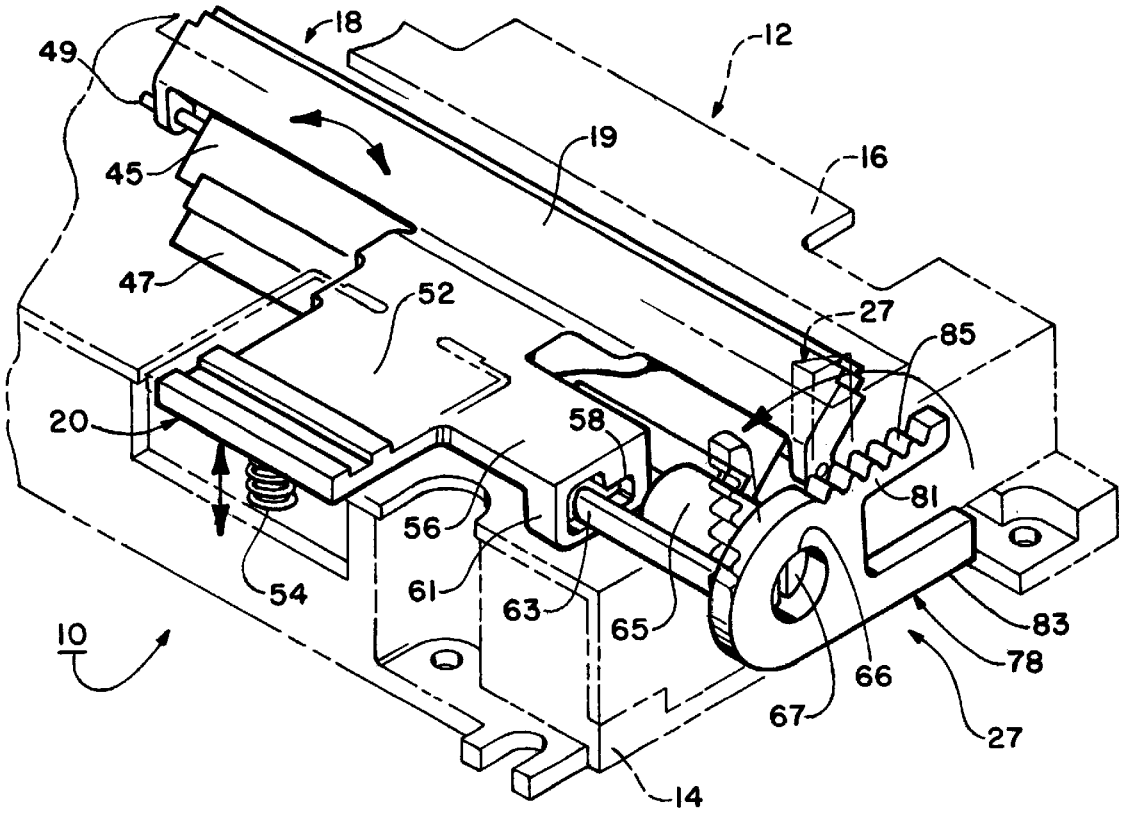
FIG. 3 is an enlarged view of the internal components of the module of FIG. 1, with the housing being illustrated in broken lines.

Referring now to the drawings, and more particularly to FIGS. 1, 2 and 3 thereof, there is shown a thermal print module 10, which is constructed in accordance with the present invention, and which is adapted to imprint information unto a thermal sensitive ink carrier in the form of thermal paper 11. The module 10 receives electrical signals from a computer or similar device (not shown) which then causes the module 10 to drive the paper 11 therethrough to imprint information thereon.

The module 10 generally comprises a two-part snap together housing 12, which includes a base part 14 which supports the internal components of the module 10, and a cover part 16 which fits over and interlocks with the base part 14 to enclose the internal components within the housing 12 when it is assembled as shown in FIG. 1. A print head assembly generally indicated at 18 includes a transverse print element carrier 19 having an electrically heated print line or element 22 which is used to selectively heat the thermal-sensitive ink carrier for imprinting purposes. The print head assembly 18 is pivotally mounted within the housing 12, and includes a spring loaded lever portion 20 which enables the assembly 18 to move toward and away from a driven transport platen or roller 21. In this regard, the print element 22 on the print head assembly 18 is normally resiliently urged into engagement with the driven platen 21 so that the carrier 11 can be driven relative to the heated print element 22.

In accordance with the present invention, an integrally connected thermoplastic spring finger 23 is connected by means of a living hinge 25 on the top surface of the cover housing part 16 to flex downwardly within an opening 26 in the top surface of the cover part 16 into engagement with the spring loaded lever portion 20 of the print head assembly 18 for causing it to move the heated print element 22 away from the driven transport platen 21 so that the carrier 11 can be adjusted manually relative to the print element 22 for adjustment purposes. In this manner, the housing 12 is composed of suitable thermalplastic material, and thus is an insulator so that the fingers of the user depressing the spring finger 23 would be protected from inadvertently contacting the heated print head assembly 18, including its lever portion 20. Thus, the user can easily and conveniently adjust the carrier 11 relative to the heated print element 22 by merely depressing the thermalplastic spring finger 23 to, in turn, cause the print head assembly 18 to pivot, as hereinafter explained in greater detail.

As an alternative, the print element 22 can be retracted from the driven platen 21 for inserting the carrier 11 into printing position between the print element 22 and the platen 21. The carrier 11 is typically in the form of a web of thermal paper wound on a roll (not shown), and the end of the paper web is fed through an opening 28 in the top surface of the cover part 16 into a position between the print element carrier 19 and the platen 21. The web 11 then extends about the underside of the driven platen 21 and exits a front opening 30 in the base housing part 14 as best seen in FIGS. 1 and 2 of the drawings.

In order to facilitate the carrier loading operation, a two-position platen control lever 27 is rotatably mounted the side of the housing 12 and rotates between a platen closed position shown in solid lines in FIGS. 1, 2 and 3, where the print head assembly 18 is disposed in its printing position, and a platen open position as indicated in phantom lines in FIG. 3 where the print head assembly 18 is retracted away from the platen 21 so that the carrier 11 can be inserted therebetween. Once the carrier 11 is installed in place, the lever 27 is then rotated through approximately 90 degrees to its position as shown in solid lines.

Figure 7:
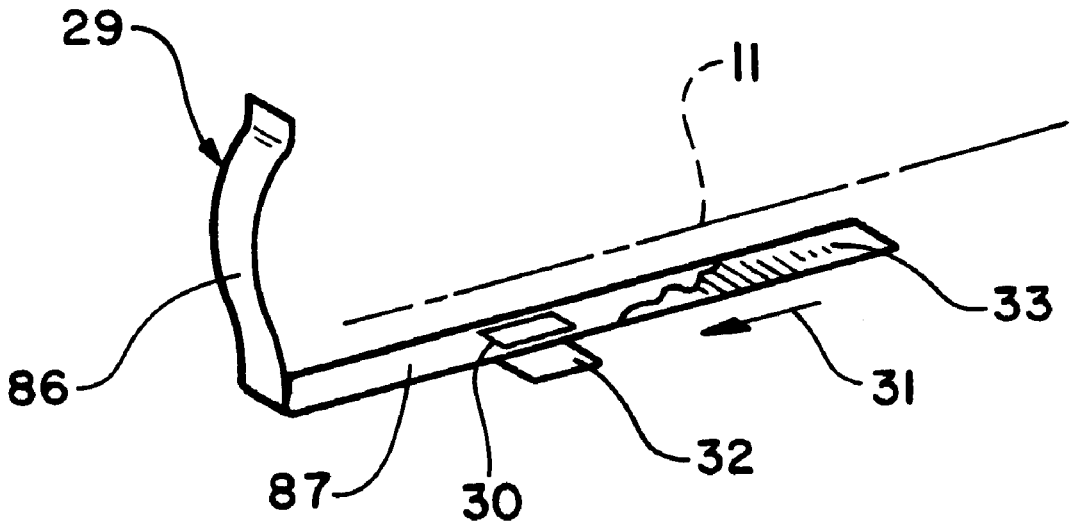
FIG. 7 is an enlarged partially broken away pictorial view of a sensor illustrating its dual mode of operation as detecting a platen open condition as well as a paper present condition.

As shown in FIGS. 1, 2, and 7 a sensor 29 is normally held in a position as indicated in FIG. 1, by the lever 27 being disposed adjacent to the side wall of the cover part 16. When the lever 27 is rotated into its upright platen open position as indicated in broken lines in FIG. 3, the springy sensor 29 is permitted to extend outwardly through an opening 31 in the side of the cover part 16, and in so doing, a switch element 32 (FIG. 2) detects the movement of the sensor 29 to cause an electrical signal to de-activate the printing operation of the module 10. The switch element (shown diagramatically) is preferably a photo-optic device. As hereinafter described in greater detail, the sensor 29 serves a dual function of determining a platen open condition when the lever 27 is raised, and of deterring a paper present condition. Thus, when either the platen is opened, or paper is absent, the sensor 29 in combination with the photo-optic device or element 32 de-activates the print head assembly 18.

Considering now the print head assembly 18 in greater detail, as shown in FIG. 2, an electrical motor 34 mounted fixedly within the base housing part 14 drives the platen 21 by means of a gear train generally indicated at 36, and including gears 38, 41 and 43. A circuit board 45 (FIG. 3) contains electrical circuitry for the print element 22, and includes circuit board connectors, such as the connector 47, to enable the circuit board 45 and the print element 22 to be connected electrically to the computer or other device for driving the print element.

The print head assembly 18 generally comprises a generally T-shaped body 48 pivotally mounted within the housing 12 by means of a pivot rod 49 (FIG. 3). The T-shaped body 48 includes a longitudinal number 52 terminating edits rear distal and end the spring loaded lever portion 20, and the transverse print element carrier 19 at its front end, whereby the print element carrier 19 is disposed on the front side of the transversely extending pivot rod 49, and the spring loaded lever portion 50 is disposed on the rear side of the pivot rod 49 so that when the spring finger 23 is depressed to, in turn, depress the lever portion 20, the print head assembly 18 pivots about the pivot rod 49 to lower the rear lever portion 20 and to raise the print element carrier 19 and its print element 22 disposed thereon away from the platen 21 to free the carrier 11 from the driven platen 21.

A spring 54 is mounted between the base housing part 14 and the underside of the rear lever portion 20 to bias it upwardly away from the lower portion of the base part 14, whereby the print head assembly 18 is biased by the spring 54 to resiliently urge the print element 22 into engagement with the platen 21. Thus, after the lever portion 50 is depressed by means of depressing the spring finger 23, the user releases the pressure on the spring finger 23 to cause the compressed spring 54 to snap back to its original position to urge the print element 22 into engagement with the platen 21.

In order to enable the two-position lever 27 to pivot the print head assembly 18, the assembly 18 includes an integrally connected transverse stub 56 extending from the longitudinal number 52 and has an L-shaped cam recess in the face of a depending enlarged distal end 61 thereof for receiving a cam follower 63 integrally connected to an integral circular rim at an aligned hole 66 journaled for rotation about an axle stub 67 extending transversely from the base housing part 14, whereby the lever 27 is rotatably mounted on the axle stub 67.

Figure 5:
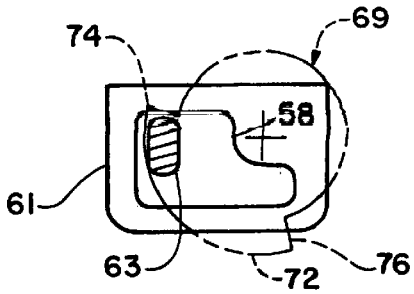
FIG. 5 is an enlarged view of the module of FIG. 1 illustrating the position of the components in the platen closed position.
Figure 6:
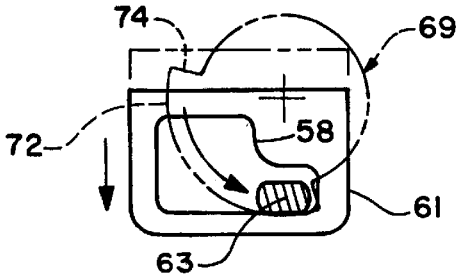
FIG. 6 is an enlarged detail view similar to the view of FIG. 5, illustrating the module in the platen open position.

As shown in FIGS. 2, 5 and 6, a housing part cam hole or opening 69 receives the circular rim 65 and the cam follower 63 integrally connected thereto. The opening 69 includes an enlarged 90° sector portion 72 to define at the opposite angular end portions thereof, a pair of stop shoulders 74 and 76 to limit the angular motion or movement of the cam follower 63 through approximately 90°, as indicated in FIGS. 5 and 6. Thus, the cam follower moves accurately between platen open and closed position through approximately a 90 degree path of travel.

Figure 4:
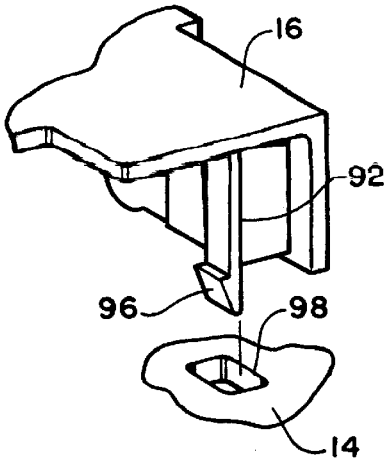
FIG. 4 is an enlarged detail of the two-part housing, illustrating the manner of interconnection.

As indicated in FIGS. 3, 4 and 5, when the lever 27 is disposed in the platen closed position, the cam follower 63 of the lever 27 is disposed at the shoulder 74 defined by the opening 69. When the lever 27 is rotated in the direction of the curve arrow in FIG. 3 into an upright position as indicated in broken lines in FIG. 3, the cam follower 63 rotates accuately through approximately 90° into engagement with the shoulder 76 to move forcibly the stub 56 of the print head assembly 18 downwardly in opposition to the spring 54. Due to the generally rectangular cross section of the cam follower 63 as shown in FIGS. 5 and 6, the cam follower 63 rests on the bottom edge of the opening of 58 with its flat surface disposed there against. In this manner, the lever 27 is maintained in its upright platen open position, since the depending distal end 61 is prevented from moving the cam follower 63. Thus, the lever is retained in its upright position, until it is pivoted in a reverse direction through approximately 90° into the solid line position as shown in FIG. 3, whereby the cam follower 63 moves arcuately through approximately 90° against the shoulder 74.

Considering now the lever 27 in greater detail, the lever 27 includes a Y-shaped crank 78 having the circular aligned hole 66 therein. The crank 78 includes a pair of legs 81 and 83. The leg 81 includes a saw tooth edge 85 on the outer surface thereof so that the first finger of the user can extend between the legs 81 and 83, and the thumb of the user engages the saw tooth edge 85 to rotate the lever 27 in a convenient manner.

Referring to FIGS. 2 and 7, the sensor 29 is composed of an L-shaped strip of metallic material. The sensor 29 includes an outwardly bowed leg 86 which is urged resiliently inwardly into the housing 12 by the leg 83 of the lever 27 when it is disposed in the platen closed position as indicated in FIG. 1. When the lever 27 is disposed in the upright platen open position, the bowed leg 86 springs outwardly to move a transverse extending sensor leg 87 slightly outwardly to interact with the photo-optic switch device 32 for de-activating the printing operation of the module 10.

The sensor 29 includes a hole or opening 30 in the leg 87 normally aligned as shown in FIG. 7 with the photo-optic element 32 when the lever 27 is disposed in its position as shown in FIG. 1. In this position, the photo-optic element 32 detects the carrier or paper 11 disposed in this platent closed printing position as indicated in FIG. 1, and generates a paper present signal to permit the circuits (not shown) controlling the print head assembly 18 to be activated so that a printing operation can occur.

In the absence of the paper 11, such as when the paper supply is exhausted, the photo-optic element 32, which generates as signal indicting the absence of the paper. In response thereto, the circuits abruptly de-activate the print head assembly 18 to prevent it from heating and thus causing damage to the platen 21 when the paper is absent. The signal indicating the absence of the paper can also be used to activate an indicator (not shown) to alert the attendant that a fresh supply of paper should be installed in the module 10.

Once the paper is installed, the photo-optic element 32 again generates its paper present signal to cause the print head assembly 18 to be activated so that printing operations can commence.

When the paper is installed in the module 10, the lever 27 is moved to its upright position to retract the print head assembly 18 from the platen 21, and thus the sensor 29 slides in the direction of the arrow 31 of FIG. 7 as previously described. Thus, the opening 30 moves out of alignment with the photo-optic element 32. A black or non-flective layer or coating 33 on the underside of the sensor leg 87 is then disposed in alignment with the photo-optic element 32 so that it generates a signal to de-activate the print head assembly 18 due to the platent open condition. Once the lever 27 returns to the platen closed position, lever 27 forces the sensor 29 in its opposite direction against the force of the spring tension of the bowed leg 86 a until the opening 30 is disposed opposite to the photo-optic element 32, which then caused the print head assembly to be activated.

Therefore, the sensor 29 in combination with a single photo-optic element 32 perform a dual function of detecting the presence and absence of the paper 11, and also of detecting a platen open condition. In this manner, only a single element 32 is required, instead of requiring a second such element, which is relatively expensive.

In order to facilitate the convenient assembly of the housing parts 14 and 16 as indicated in FIG. 2, the cover housing part 16 has a set of depending spring fingers, such as the spring fingers 89 and 92 having respective barb distal end portions 94 and 96, which are received in respective openings 97 (FIG. 2) and 98 (FIG. 4) in the base part 14. In this manner, the spring fingers slip into the corresponding openings in the base part 14 and are retained fixably in place by the barbed distal end portions of the spring fingers. In this manner, the housing parts are fixedly secured together to help protect the inner components of the module 10, and the housing 12 is readily and conveniently assembled in a low cost manner.

While a particular embodiment of the present invention has been disclosed, it is to be understood that various different modifications are possible and are contemplated within the true spirit and scope of the appended claims. There is no intention, therefore, of limitations to the exact abstract or disclosure herein presented.

What is claimed is:

1. A thermal print module for printing on thermo-sensitive ink carrier, comprising:

a housing composed of thermoplastic material;

a print head assembly having a print element and being pivotally mounted at least partially within said housing, said print head assembly having a spring loaded lever portion for causing said print head assembly to move pivotally within said housing when a force is applied to it;

a driver transport platen for cooperating with said print head assembly to drive the ink carrier into a printing position relative to said print head;

means defining an opening in said housing opposite said lever portion;

spring finger means being composed of thermoplastic material and being integrally formed on said housing within said opening, said spring finger being pivotally movably thereon for engaging said lever portion when said spring finger means is depressed forcibly manually into engagement with said lever portion to cause it to pivot said print head assembly away from said transport platen, and living hinge means interconnecting said spring finger to said housing within said opening.

2. A thermal print module according to claim 1, wherein said print head assembly includes a generally T-shaped body having said print head assembly mounted on a transverse print element carrier and having a longitudinal member terminating in said lever portion;

further including spring means for urging resiliently the print element on said body into engagement with said platen.

3. A thermal print module according to claim 1, further including a rotatably mounted platen control lever for causing said print head assembly to move between platen open and platen closed positions.

4. A thermal print module according to claim 3, further including a sensor for interrupting the printing operation when said platen control lever is moved to its platen open position or when the carrier is absent.

5. A thermal print module according to claim 4, wherein said sensor is generally L-shaped and is composed of springy material, said sensor having a bowed leg for engaging said platen control lever and having a slidably mounted transverse leg, further including switch means for interacting with said transverse leg.

6. A thermal print module according to claim 5, wherein said switch means includes a photo-optic element, and said sensor transverse leg includes means defining an opening to cooperate with said element.

7. A thermal print module according to claim 3, wherein said platen control lever includes a cam follower, and said print head assembly includes a recess for receiving the distal end of said cam follower, said housing having a cam opening for receiving said cam follower.

8. A thermal print module according to claim 7, wherein said recess being generally L-shaped, and said cam opening is generally circular and includes an arcuate sector to cause said cam follower to move through an arcuate path of travel of approximately 90°.

9. A thermal print module according to claim 8, wherein said means defining said cam opening includes a pair of stop shoulders.

10. A thermal print module for printing on thermo-sensitive ink carrier, comprising:

a two-part snap together housing composed of thermo-plastic material;

a print head assembly mounted within said housing;

driven transport platen mounted within said housing for cooperating with said print head assembly to imprint thermally the carrier;

said housing having a base part for supporting said print head assembly and said platen;

said housing having a cover part for fitting over and fixedly engaging said base part to enclose said print head assembly and said platen;

one of said parts having a plurality of spring fingers having barb distal end portions; and the other one of said parts having a plurality of openings to receive corresponding ones of the barb distal end portions for interlocking the housing parts in a convenient manner.

11. A thermal print module for printing on thermo-sensitive ink carrier, comprising:

a housing;

a print head assembly having a print element and being pivotally mounted within the housing;

a driven transport platen for cooperating with said print head assembly to drive the ink carrier into a printing position relative to said print head assembly;

a two-position platen control lever pivotally mounted on the outside of the housing for causing said print head assembly to pivot away from the platen for ink carrier loading purposes; and said lever having a crank to enable the lever to be moved manually through an arcuate path of travel.

12. A thermal print module according to claim 11, wherein said print head assembly includes a generally T-shaped body having said print head assembly mounted on a transverse print element carrier and having a longitudinal member terminating in said lever;

farther including spring means for urging resiliently the print element on said body into engagement with said platen.

13. A thermal print module according to claim 11, further including a platen open sensor for interrupting the printing operation when said platen control lever is moved to its platen open position or when the carrier is absent.

14. A thermal print module according to claim 13, wherein said sensor is generally L-shaped and is composed of springy material, said sensor having a bowed leg for engaging said platen control lever and having a slidably mounted transverse leg, further including switch means for interacting with said transverse leg.

15. A thermal print module according to claim 14, wherein said switch means includes a photo-optic element, and said sensor transverse leg includes means defining an opening to cooperate with said print element.

16. A thermal print module according to claim 14, wherein said platen control lever includes a cam follower, and said print head assembly includes a recess for receiving the distal end of said cam follower, said housing having a cam opening for receiving said cam follower.

17. A thermal print module according to claim 16, wherein said recess being generally L-shaped, and said cam opening is generally circular and includes an arcuate sector to cause said cam follower to move through an arcuate path of travel of approximately 90°.

18. A thermal print module according to claim 17, wherein said cam opening includes a pair of stop shoulders.

19. A method of using a thermal print module, the thermal print module being constructed according to claim 11, the method comprising rotating said platen control lever between a platen open and a platen closed positions.

* * * * *